United States Patent [19]

Heritage

[11] 3,960,426

[45] June 1, 1976

[54] ELECTRICAL INSTALLATION

[75] Inventor: Robert Heritage, Mortlake, England

[73] Assignee: Rotaflex (Great Britain) Limited, London, England

[22] Filed: Sept. 24, 1975

[21] Appl. No.: 616,506

[30] Foreign Application Priority Data

Oct. 2, 1974 United Kingdom ..... 42797/74

[52] U.S. Cl. ..... 339/21 R; 339/75 R

[51] Int. Cl.[2] ..... H01R 13/60

[58] Field of Search ..... 339/20, 21 R, 22 R, 339/22 B, 75 R, 75 M, 78

[56] References Cited

UNITED STATES PATENTS

| | | | |
|---|---|---|---|
| 3,611,252 | 10/1971 | Fremont | 339/21 R |
| 3,757,273 | 9/1973 | Hesse | 339/21 R |
| 3,894,781 | 7/1975 | Donato | 339/75 M |

*Primary Examiner*—Roy Lake
*Assistant Examiner*—Mark S. Bicks
*Attorney, Agent, or Firm*—Arthur B. Colvin

[57] ABSTRACT

A power take-off adaptor for a continuous outlet electrical supply installation has separate and independently manually rotatable shafts for operating contact fingers and mechanical fixing means respectively. The shafts have interengaging radial cam formations which prevent operation of the contact fingers except when the mechanical fixing means is operative.

3 Claims, 7 Drawing Figures

ELECTRICAL INSTALLATION

This invention relates to power take-off adaptors for electrical installation of the continuous outlet type comprising a channel section track member having spaced, parallel conductors extending longitudinally of the track. Adaptors for use in such installations are used for tapping off power from the track conductors and usually also serve to support appliances, such as light fittings, from the track members.

It is known for example from British Pat. Specification No. 1000925 for such an adaptor to comprise a housing, contact fingers movable with respect to the housing between operative and inoperative positions by manual operation of a first rotary member and mechanical fixing means operable to secure the adaptor releasably to a track member by manual rotation of a second rotary member independently of the first rotary member.

Such an adaptor is generally satisfactory in use and can be of very simple and rugged construction, but it does allow the possibility of misuse, for example by the operator failing to engage, or fully engage the mechanical fixing means with the track. It is possible for the user to operate only the contact fingers with the result that the adaptor (and any appliance secured to it) will come away from the track and be damaged and/or cause personal injury.

In accordance with the present invention however, the two rotary members have mutually interengageable portions which only permit rotation of the first rotary member when the second rotary member is in an operative position corresponding with the securing position of the fixing means.

One constructional form of the invention will now be described, by way of example, with reference to the accompanying diagrammatic drawings, in which.

Figure 1:
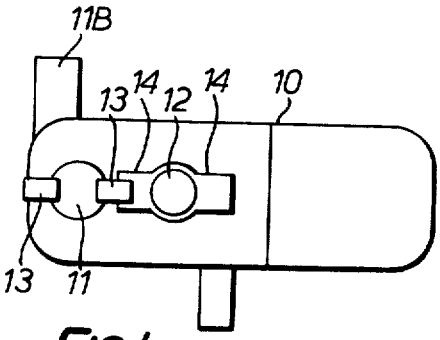
FIGS. 1 to 3 are top plan views of an adaptor in accordance with the invention with the parts in different positions of adjustment.

The adaptor shown in the drawings comprises a hollow housing 10 of electrically insulating material supporting two spaced, parallel rotary members 11 and 12, which extend completely through the housing from top to bottom. The first member 11 carries two contact fingers 13 insulated from each other and extending radially outwardly of the member 11 in diametrically opposed positions. The fingers 13 are connected inside the housing 10 to terminals for connection in turn to a flex or other lead of an appliance, in known manner.

The second rotary member 12 has at its upper end a pair of oppositely radially directed locking lugs 14.

Figure 4:
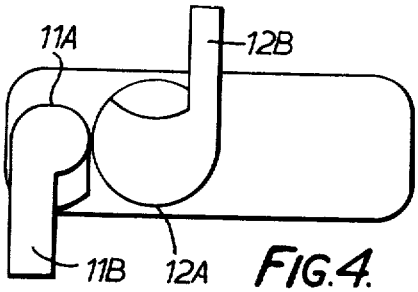
FIGS. 4 to 6 are bottom plan views corresponding to FIGS. 1 to 3 respectively.
Figure 3:
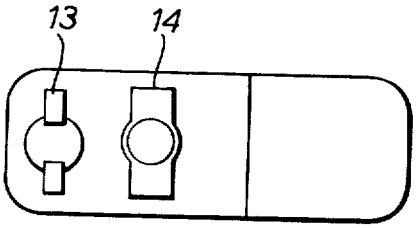
Figure 6:
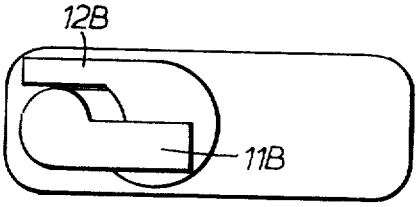
Figure 7:
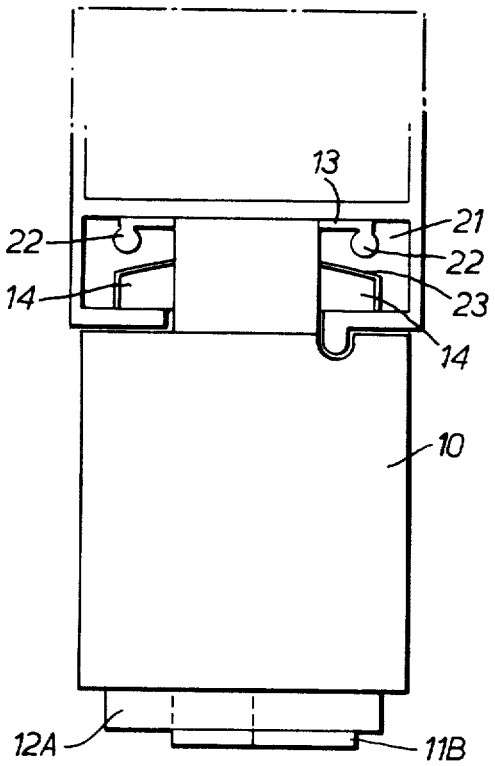
FIG. 7 is an end view showing the adaptor engaged in a track member.

Both members 11 and 12 are rotatable through 90° from retracted or disengaged positions shown in FIGS. 1 and 4, to the fully engaged or operative positions shown in FIGS. 3, 6 and 7.

Figure 2:
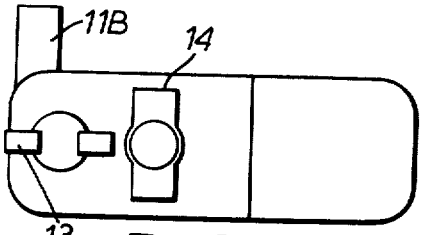
Figure 5:
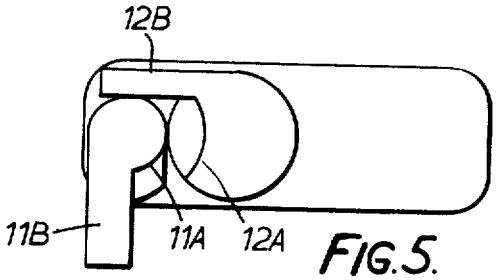

The members 11, 12 are formed at their lower ends, outside the housing 10, with respective radial cam formations 11A, 12A and handles 11B, 12B respectively. In the positions shown in FIGS. 1 and 4, rotation of the member 11 is prevented by interference of the adjacent profiles of the formations 11A, 12A. FIGS. 2 and 5 show the adaptor with the member 12 rotated to its fully engaged positions, in which the lugs 14 extend laterally outwardly for engagement in longitudinal recesses, and in which a recess in the profile of cam formation 12A is brought adjacent formation 11A, allowing the first member 11 to turn through 90° to the position shown in FIGS. 3 and 6, in which the contact fingers 13 extend laterally for engagement with the track conductors. With the first rotary member in this position, the formation 11A, 12A interlock to prevent return of the member 12 to its original position.

The adaptor is thus safeguarded in a simple but effective manner against engagement and disengagement of the contacts 13 with the track conductors except when the mechanical locking lugs 14 are engaged in the track. Furthermore, the cam formation are outside the housing, so that they are visible to the user.

FIG. 7 shows the adaptor fully engaged electrically and mechanically in a track comprising a channel 20, insulated support 21 and track conductor 22, the support 21 defining with the track channel recesses 23 to receive the locking lugs 14.

The same general principles of interlocking are obviously applicable also to tracks having 3,4 or more conductors, and are subject to many other detail modifications.

I claim:

1. For use with an electrical current supply installation of the continuous outlet type comprising a channel-section track member having spaced parallel conductors extending longitudinally within said track member; a power take off adaptor comprising a housing, contact finger means movably mounted on said housing for movement between operative and inoperative positions, mechanical fixing means mounted on said housing operable to secure said housing to said track member, first and second rotary members independently and manually rotatable to operate said contact finger means and said mechanical fixing means respectively, and respective mutually interengageable portions on said first and second rotary members which interlock to prevent rotation of said first rotary member when said second rotary member is in an inoperative position.

2. An adaptor as claimed in claim 1, wherein said first and second rotary members are parallel with each other and said interengageable portions comprise respective radial cam means on said members.

3. An adaptor as claimed in claim 2, wherein said first and second rotary members extend through a wall of said housing which wall is spaced from said track member in use of the adaptor, and said cam portions are disposed outside said housing so as to be visible to a user of said adaptor.

* * * * *